US005082238A

United States Patent [19]

Grooms et al.

[11] Patent Number: 5,082,238

[45] Date of Patent: Jan. 21, 1992

[54] NONJAMMING VACUUM VALVE HAVING TAPERED PLUNGER

[75] Inventors: John M. Grooms, Rochester; Mark A. Jones, Cloverdale, both of Ind.

[73] Assignee: Burton Mechanical Contractors

[21] Appl. No.: 576,179

[22] Filed: Aug. 30, 1990

Related U.S. Application Data

[63] Continuation of Ser. No. 366,585, Jun. 15, 1989, abandoned.

[51] Int. Cl.[5] ..... F16K 31/126

[52] U.S. Cl. ..... 251/61.5; 137/205; 137/236.1; 137/907

[58] Field of Search ..... 137/907, 205, 236.1; 251/61.5

[56] References Cited

U.S. PATENT DOCUMENTS

| | | | |
|---|---|---|---|
| 2,504,057 | 4/1950 | Trefil | 251/318 |
| 3,476,147 | 11/1969 | Hitt et al. | 251/211 X |
| 3,762,384 | 10/1973 | Day et al. | 137/907 X |
| 3,807,431 | 4/1974 | Svanteson | 137/205 |
| 3,824,033 | 7/1974 | Chacour | 137/219 X |
| 4,009,865 | 3/1977 | Davlin | 251/318 |
| 4,171,853 | 10/1979 | Cleaver et al. | 251/61.5 X |
| 4,223,701 | 9/1980 | Bible et al. | 137/907 X |
| 4,674,464 | 6/1987 | Akagi | 123/571 |
| 4,732,192 | 3/1988 | Shen | 251/339 X |
| 4,782,811 | 11/1988 | Hewette | 123/571 |
| 4,826,132 | 5/1989 | Moldenhauer | 251/333 X |

FOREIGN PATENT DOCUMENTS

| | | | |
|---|---|---|---|
| 2311426 | 9/1974 | Fed. Rep. of Germany | 251/61.5 |

*Primary Examiner*—Gerald A. Michalsky

[57] ABSTRACT

A vacuum valve having a substantially tapered plunger for use in a vacuum operated sewerage transport system, the valve capable of facilitating a flow rate of thirty gallons per minute. It will not jam in the open or semi-open position as a result of repetitive cycling of the valve by the associated control unit. The plunger is mounted at one end of an axially disposed shaft of a piston operator in the valve chamber, which is effectively sealed to prohibit air leakage into a vacuum pressure conduit when the valve is in the closed position. Additional sealing elements are required and are designed to seal all liquids from entering the chambers containing the piston driving means or its associated control unit.

11 Claims, 4 Drawing Sheets

NONJAMMING VACUUM VALVE HAVING TAPERED PLUNGER

This a continuation of copending application Ser. No. 07/366,585 filed on Jun. 15, 1989, now abandoned.

BACKGROUND OF THE INVENTION

The present invention relates generally to vacuum-operated sewerage control systems utilizing inlet vacuum valves and more particularly to such a system employing an inlet vacuum valve having a tapered plunger to prevent valve jamming and subsequent air leakage as the vacuum seal is impaired.

An operational vacuum sewerage transport system requires that each sewerage inlet point, typically serving one or more houses, include a vacuum valve and controller assembly, providing for intermittent passage of sewage accumulation into an associated transport pipe network which is continuously under vacuum. Vacuum valves are devices for sealing and unsealing the passage between two parts of an evacuated system.

The general structure and method of operation of this type of vacuum valve is described in U.S. Pat. No. 4,171,853 (Cleaver et al). The inlet vacuum valve and controller assembly of the prior art is typically located in a covered pit several feet below ground level for direct in line connection with the transport sewer pipe. Accordingly, inlet vacuum valves in the prior art are opened in response to receiving a signal from a control unit, thereby allowing accumulated sewage to flow into the vacuum sewerage transport system to a remote collection station for further transport to a treatment facility. These vacuum valves are operationally closed to seal the vacuum system by atmospheric pressure that is permitted to enter the internal upper housing of the vacuum valve, in response to a signal from the associated control unit, thereby allowing an internal spring member located in the upper housing to facilitate closing of the vacuum valve. The prior art construction of vacuum valves focused on a rigid plastic internal plunger located within a centrally disposed valve chamber. The plunger was usually cylindrical in shape and operatively connected to the lower end of a piston driving member having a C-shaped cup.

Generally, small stones, chips, and other solid particulate matter are present in the various connecting pipes comprising the transport apparatus of a vacuum sewerage system. Inasmuch as the vacuum valve was cylindrical in shape and contained a rigid internal cylindrical plunger that fit within the vacuum valve chamber, the physical clearance between the internal cylindrical plunger and the wall of the vacuum valve chamber was sufficiently large so as to permit small stones, chips, solid particulate matter and the like to become lodged between the side wall of the valve chamber and the exterior wall of the cylindrical plunger as the particulate matter was transported within the vacuum system during operation of the system. Upon occasion, this caused the cylindrical plunger to become jammed against the wall of the internal valve chamber while the vacuum valve was being pulled to the open position, thereby damaging and not facilitating Proper closing of the vacuum valve when so required by the associated control unit. This would result in continuous air and fluid leakage through the partially open vacuum valve and improper operation of the valve. In addition, the leaking air and fluid would impair efficient operation of the overall vacuum transport system. To restore operation of the system, maintenance personnel had to identify which of the numerous valves had failed and service each of the valves.

Additionally, it was discovered, under repetitive vacuum cycling, that the rubber seat at the end of the rubber cylindrical plunger, which physically engages the internal valve stop of the wye body conduit pipe when the vacuum valve was in the "closed" position, would tend to be pulled away from the end of the cylindrical plunger as the vacuum valve was opened. This would allow small stones, chips, and other solid particulate matter to become lodged between the rubber seat and the end of the plastic cylindrical plunger. This interfered with proper valve closure causing the vacuum valve to leak when in the "closed" position during operation.

The internal valve stop of the wye body conduit pipe of the prior art vacuum valve apparatus was positioned adjacent and below the rubber seat at the end of the plastic cylindrical plunger and would, upon occasion, leak, thereby permitting undesirable air and fluid leakage into the system. Additionally, because of the tight tolerances required between the internal valve seat of the wye body and the rubber stop at the end of the cylindrical plunger, slight deviations in the angle of machining of the valve seat would cause the cylindrical plunger to incorrectly engage the opposed valve stop of the body. Subsequently, this incorrect seating would become yet another source of leakage of air and fluid from the holding sump into the vacuum main.

Another problem experienced in the use of prior art vacuum valves involved leakage through the seal for the valve operating shaft. This seal is provided between the valve and the piston cup to prevent pressure communication between the piston cup and valve chambers of the valve body. Leakage was found to occur in prior art assemblies. Leakage would permit fluid contamination through the seal assembly and into the control unit for the inlet vacuum valve by way of gradual seepage at points about the outer peripheral edge of an internal diaphragm which acts to separate the valve into upper and lower chambers, thereby damaging the individual control unit over time. To the extent sewage contamination leaked into the vacuum chamber of the vacuum valve, or into the associated control unit, maintenance of the vacuum valve was exacerbated and system reliability was impaired.

A common disadvantage relating to the vacuum valves of the prior art is the labor costs associated with locating, servicing and repairing damaged vacuum valves. Also, when damage does occur to the cylindrical plunger of a prior art vacuum valve, replacement of the total vacuum valve is usually required as the most expedient corrective measure. Should the valve be damaged in such a manner so as to result in the occurence of fluid contamination being able to leak into the vacuum valve, an increase in the expense of routine and proper maintenance for all the parts of the vacuum valves and associated control modules will be increased accordingly.

OBJECT OF THE PRESENT INVENTION

Accordingly, it is a primary objective of the present invention to provide an improved internal plunger for a vacuum valve which will tolerate small stones and the like, while properly closing following cycling of the valve, and which will overcome the deficiencies experienced in prior art systems.

Another objective of the present invention is to provide a vacuum valve which will not leak during normal repetitive cycling of the valve during vacuum system operation.

It is still another object of the present invention to provide a vacuum valve which will improve vacuum system reliability by improving the durability and ruggedness of the internal plunger of the vacuum valve.

SUMMARY OF THE INVENTION

In practicing the invention, a non-jamming vacuum valve is provided having an open and closed position. One of the valve elements is a rigid, substantially tapered, moveable plunger. The lower end of the plunger has a flexible valve seat securely fastened thereto at an angle to the central axis of the plunger. The seat of the moveable plunger is designed to engage and close an immoveable mating valve stop element formed in a conduit or pipe of a sewerage transportation system having a first inlet opening to atmospheric pressure and a second outlet opening to vacuum or subatmospheric pressure. Also present are the structures of the invention for sealing the vacuum valve components against fluid contamination, and the means to open and close the vacuum valve in accordance with a Predetermined pattern or schedule.

In one embodiment of the present invention, a non-jamming vacuum valve having an open position and a closed position is provided. The vacuum valve comprises a piston, having a top end and a lower end opposite the top end, and certain other component assemblies. Present is a screw plug and lower piston housing assembly comprising an O-ring of a predetermined size and tension, a screw plug to which the O-ring is attached, the screw plug having a top face, a wiper shaft seal of a predetermined size, a bearing which is secured to the top face of the screw plug after the wiper shaft seal is centrally secured to the bearing, another O-ring of a predetermined size and tension secured to the top face of the screw plug, and a lower piston housing which is secured to the top face of the screw plug. A separate upper piston housing assembly comprises a piston plate, a flexible rolling diaphragm having an outer flexible edge about its circumference, a C-shaped piston cup which nests within the rolling diaphragm, a spring member which is placed within the piston cup to bias the vacuum valve in the closed position, and an upper piston housing. The rolling diaphragm is operationally secured along its outer edge between the upper piston housing and the lower piston housing, the upper piston housing being operationally secured to the lower piston housing. There also exists a certain wye body conduit or pipe, adapted to receive the screw plug, and having a centrally disposed vacuum valve chamber into which the piston is fitted, the conduit having a first inlet end at atmospheric pressure and a second outlet end at vacuum or subatmospheric pressure, the wye body conduit having an internal valve stop. A rigid substantially tapered plunger is operationally secured to the lower end of the piston. The tapered plunger has a lower end, the lower end has a rubber valve seat secured thereto. The rubber valve seat physically engages the internal valve stop of the wye body conduit when the vacuum valve is in the "closed" position, thereby sealing the vacuum system.

DESCRIPTION OF THE PREFERRED EMBODIMENT

Figure 1:
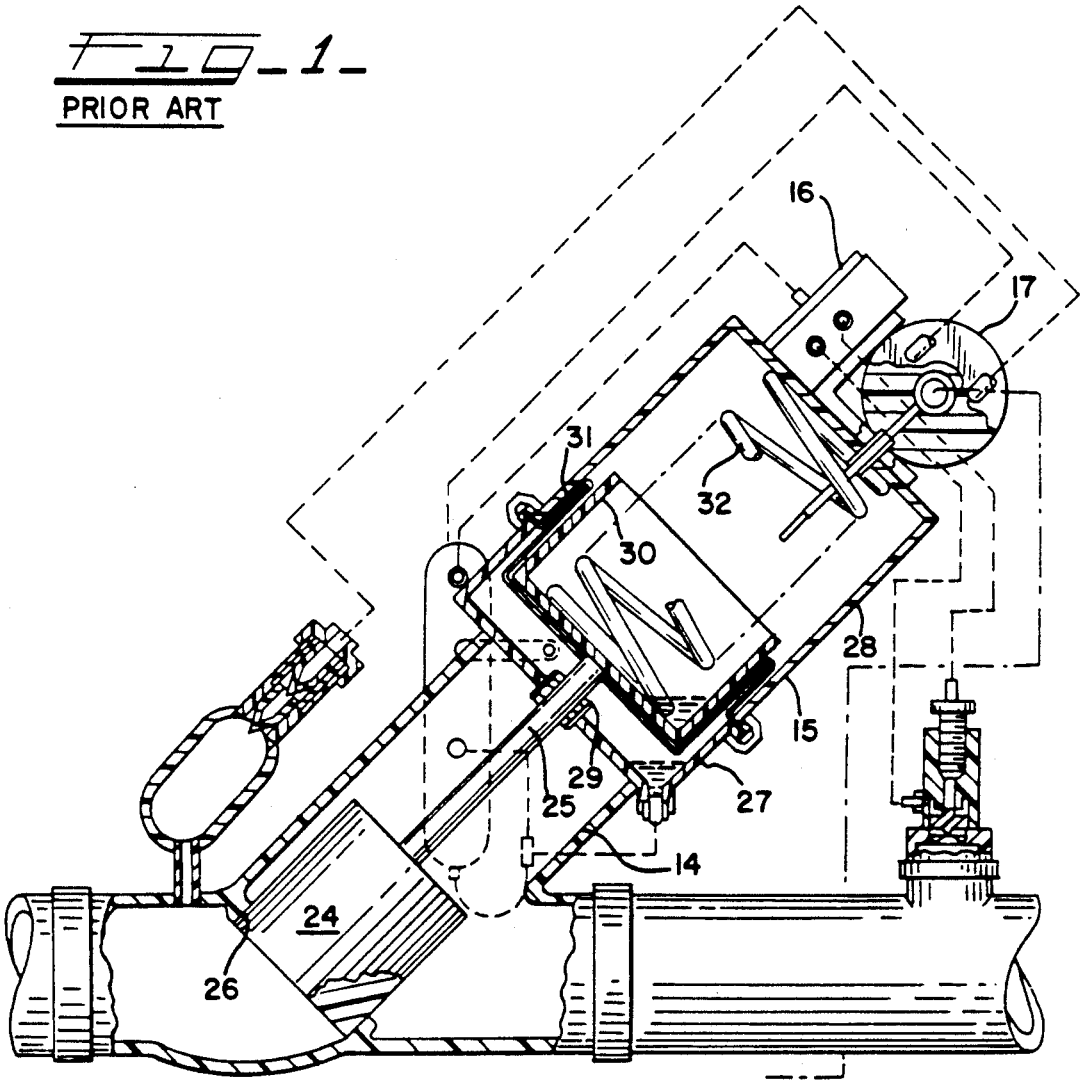
FIG. 1 PRIOR ART
FIG. 1 is an enlarged-side elevational view of a vacuum valve and controller assembly of the prior art with portions broken away in section to illustrate the construction of the major components of the valve.

FIG. 1 illustrates a vacuum valve and controller assembly associated with a vacuum operated sewerage transport system of the prior art, which is more fully described in applicants' previously issued U.S. Pat. No. 4,171,853. Generally, this prior art construction may be described as having a cylindrical plug 24, provided with an elastomer seal along its bottom edge and is mounted on the outer end of a rigid piston rod 25 for the opening and closing movement with respect to an internal valve stop 26. The piston operator 15 includes a two piece cylinder having a lower cup-shaped cylinder member 27 which is fixed at one of its ends to the closing and outer end of the pipe extension 14 and at another end to outer cup-shaped member 28. The piston rod 25 is slideably mounted in a sliding liquid seal 29 in the cylinder member 27, and is secured to the base of a cup-shaped piston 30 having a diameter slightly less than the cylinder member 27 and biased by spring 32. A flexible diaphragm 31 is operatively positioned between the cylinder member 27 and member 28 and looped upwardly with the inner end secured to the base of the cup-shaped piston 30. This divides the piston operator 15 into two separate cylindrical pressure chambers. The control unit 16 and spool valve 17 are mounted on the upper end of the outer cylinder member 28.

The present invention is particularly directed to improvements in the cylinder plug 24 for the opening and closing movement of the vacuum valve with respect to the valve stop 26, and in the liquid seal 29 slideably mounted around piston rod 25, which will minimize the entry of fluid contamination and other moisture into the internal vacuum chamber and control unit of the vacuum valve. As such elements and their functions are fully described in the above referenced patent, the descriptions herein are generally limited to the particular aspects significant to the unique features and structures provided by the present invention.

Figure 2:
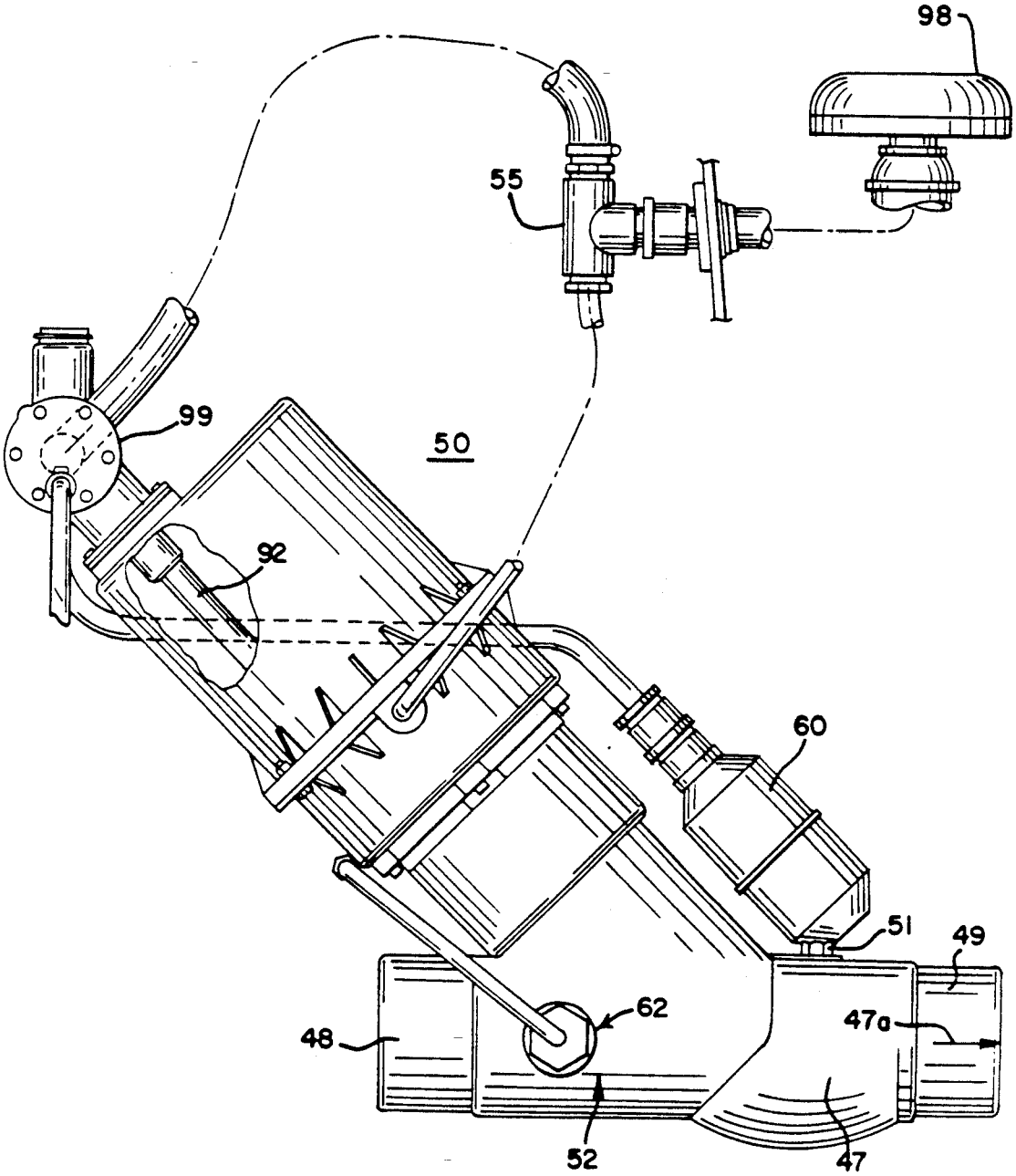
FIG. 2 is an enlarged side elevational view of the vacuum valve of the present invention.
Figure 3:
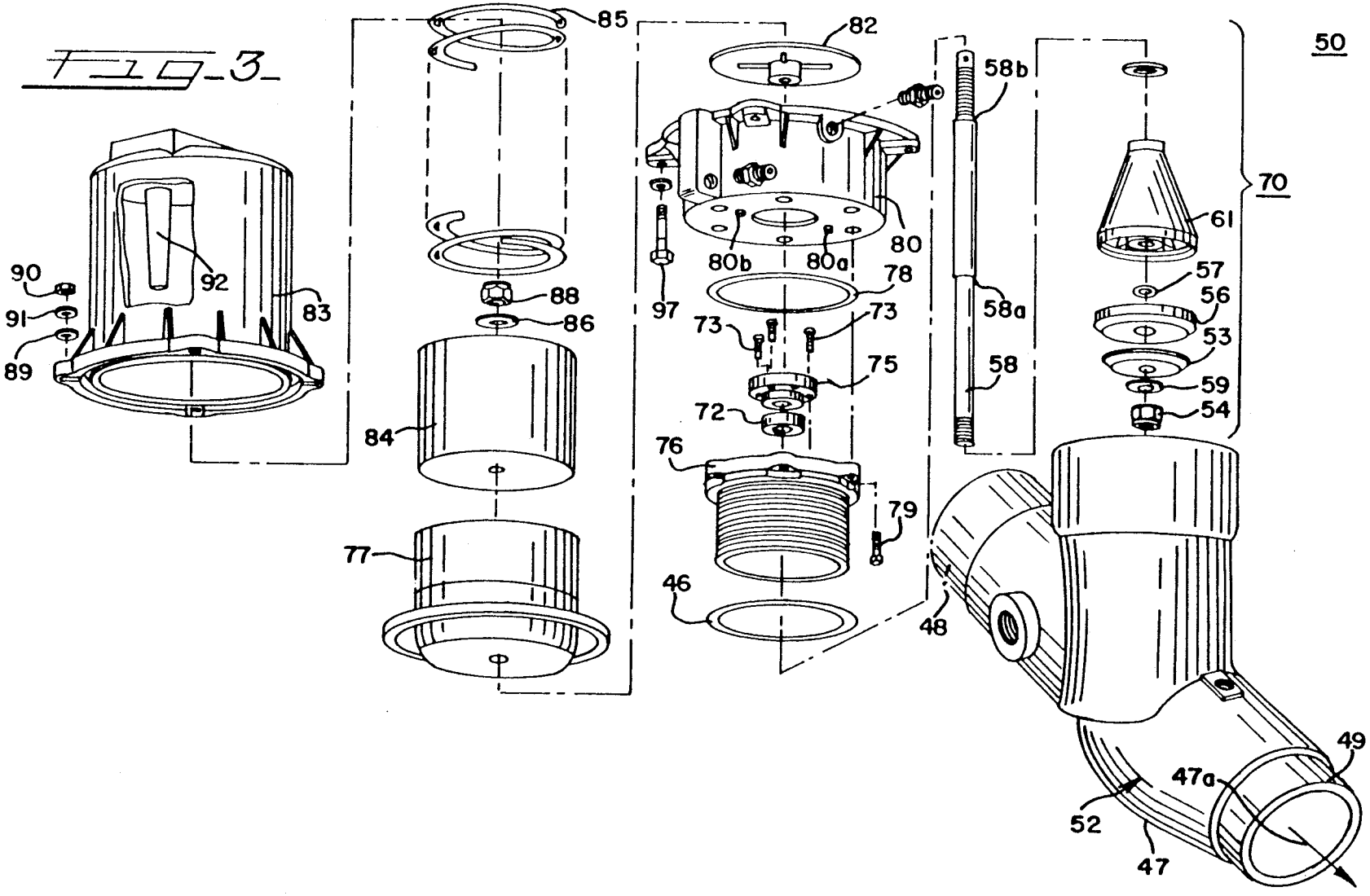
FIG. 3 is an exploded perspective view of the vacuum valve shown in FIG. 2.
Figure 4:
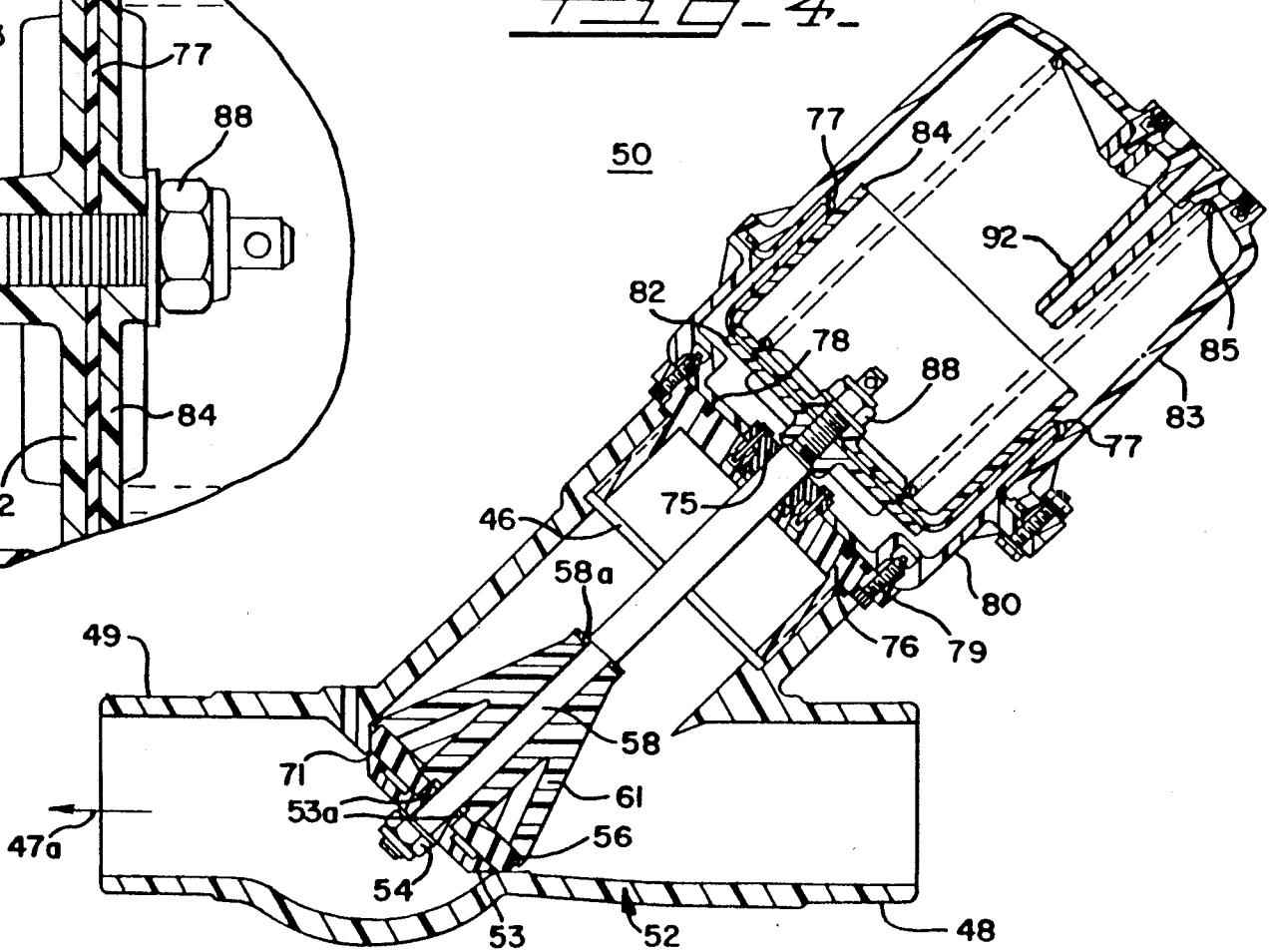
FIG. 4 is a partial cross-section view of the opposite or reverse side of the vacuum valve shown in FIG. 2, to illustrate the main cooperating components of the valve.

As shown in FIGS. 2–4, a pipe or wye body conduit 52 contains the inlet vacuum valve, shown generally as 50, and is operatively connected at 48 to the inlet branch line (from a house, which is at atmospheric pressure) to the outlet or transport service line at 49 leading to the vacuum main (i.e., the outlet sewer main, which is under vacuum or subatmospheric pressure at all times). A vacuum valve of this design and construction can operate at flow rates of about 30 gallons per minute.

The vacuum valve 50 has a surge tank 60 connected to the vacuum side of the wye body 52 which is exposed at all times to the vacuum or subatmospheric pressure. Sewerage flow will be in the direction of the arrow 47*a* projecting from front end 47 of wye body 52. A connector member 51 connects the surge tank 60 to the front end 47 of the wye body 52. The surge tank 60 serves to minimize the effect of air and liquid surges that occur within the vacuum system and will maintain the necessary vacuum or subatmospheric pressure at a relatively constant level as required by the vacuum valve unit controller 99 (mounted on top of the upper housing 83 of the inlet vacuum valve 50), even though the actual vacuum or subatmospheric pressure present in the distribution network (or in the vacuum main) may be fluctuating during operation of the vacuum system, as normally will occur during the cycling of the inlet vacuum valve 50 to its opened and closed positions. The surge tank 60 is a fusion welded assembly which is air tight in construction.

Since a portion of the wye body of the vacuum valve 50 is at atmospheric pressure, the wye body 52 requires an atmospheric check valve assembly 62 positioned in back of the internal vacuum valve stop. When the vacuum valve 50 is in the closed position, this portion of the wye body 52 will always be at atmospheric pressure, as this portion of the wye body 52 is directly connected to the branch line of pipe which is connected to a holding sump, the holding sump being connected to the gravity line feed from a house and then vented by a vent stack next to a house. When the vacuum valve 50 cycles, the internal valve stop will be opened and the vacuum of the transport system will be applied to the particular section of the system, which will act to transport the sewage through the system to the collection tank for later treatment and disposal. The atmospheric check valve assembly 62 will allow atmospheric pressure to return to the particular section of the system following cycling and closing of the vacuum valve 50 by the unit controller 99. The atmospheric check valve assembly 62 is connected to a tee connection 55, part of which runs to the unit controller 99 and part of which runs to the external breather pipe 98 (as shown in FIG. 2).

Referring now to FIGS. 3 and 4, the vacuum valve seat and lower conical plunger assembly, generally designated 70, is telescoped over the lower end of centrally disposed shaft 58. Shaft 58 is constructed of stainless steel for reliability and is the same shaft which forms the piston driving member of prior art construction. The shaft 58 has a shoulder stop 58*a* which secures the separate individual components of the valve seat and rigid lower conical plunger assembly 70 into their correct position for placement within the wye body 52. As is shown in FIGS. 3 and 4, locknut 54 secures stainless steel washer 59, rubber valve seat 56 and valve seat retaining member 53 onto the shaft 58. O-ring member 57 nests within the rubber tapered conical plunger 61 and prevents air leakage from along the shaft 58 into the outlet vacuum conduit.

As can be best seen in FIG. 4, the tapered conical plunger 61 is designed to permit maximum clearance between the interior side wall of the internal valve chamber of the vacuum valve 50 and the exterior wall of the tapered plunger 61 the cross-sectional diameter of the plunger is increasingly reduced as one moves away from the valve seat end. This will permit small objects, e.g. stones, to pass through the vacuum valve 50 upon opening without being lodged therein and jamming against the interior walls of the vacuum chamber. The plastic valve seat retaining member 53 has a centrally disposed boss portion 53*a* that, when assembled, is telescoped through the rubber valve seat 56. This will define a specific preload of compression on the rubber valve seat 56 when the vacuum valve seat and lower conical plunger assembly 70 is tightened, thereby preventing overtightening of the valve seat 56. During operation of the vacuum valve 50, as the valve seat retaining member 53 seats against the O-ring seal 57, the O-ring seal 57 will seal itself against the shaft 58, which will prevent air leakage into the wye body outlet vacuum conduit.

Referring to the second end of shaft 58 opposite plunger assembly 70, FIG. 3 illustrates wiper shaft seal 72. This is made from a rubber material and is placed in a beveled hole (shown in FIG. 5) centrally disposed on the internal face of an element identified as screw plug 76. The beveled hole is designed to orient the wiper shaft seal 72 with respect to the shaft 58. The wiper shaft seal 72 has an O-ring outer edge to seal against the screw plug 76. An inner wiper lip (not shown) of the wiper shaft seal 72 prevents any fluid contamination from being packed in the area between the shaft 58 and the wiper shaft seal 72.

Figure 5:
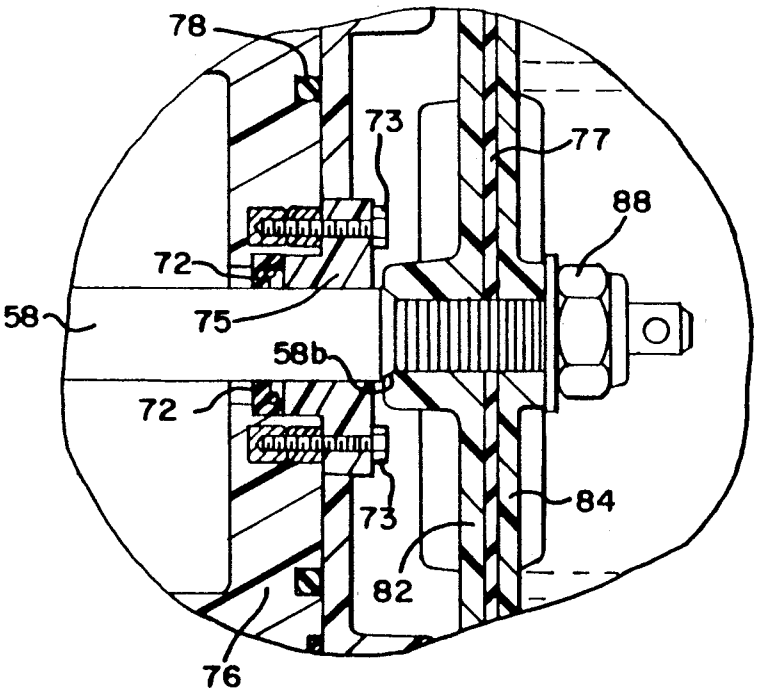
FIG. 5 is an enlarged partial cross section view of certain structural elements which effectuate sealing of the axially disposed shaft of the vacuum valve illustrated in FIG. 4.

FIG. 5 represents an enlarged partial cross section view of the elements which effectuate sealing of the axially disposed shaft 58 of the vacuum valve 50. As can be seen in FIGS. 4 and 5, replaceable bearing 75 fits within a recess formed in the face of the screw plug 76 and this permits shaft 58 to reciprocate freely without binding during operation of the vacuum valve. Bearing 75 also insures that the lower end of shaft 58 will be oriented correctly in a recess or seat found at the bottom of the wye body 52 (shown in FIG. 4). The bearing 75 is secured to the screw plug 76 by screws 73, which connect to corresponding stainless steel inserts within the screw plug 76. The flange portion of the bearing 75 is tightened against the top face of screw plug 76.

Referring again to FIG. 3, the screw plug 76 has a recessed groove in which is placed the O-ring 78, prior to connecting the screw plug 76 to the lower housing 80. The lower housing 80 has keyed locating pins 80*a* and 80*b* (of differing diameters to insure correct positioning of housing 80 on screw plug 76) which nest in their respective keyed apertures located on the top face of the screw plug 76. The screw plug 76 is attached to lower housing 80 by way of screws 79 which are fastened to the stainless steel inserts within the bottom surface of lower housing 80.

The screw plug 76 and lower housing 80 are telescoped over shaft 58. Lubricant is applied to the central portion of the shaft 58. As shown in FIG. 5, the shaft 58 is threaded through piston plate 82, which rests on the tapered shoulder 58*b* of shaft 58.

A lubricating film is applied to the rolling diaphragm 77, which is then placed over the end of shaft 58, which protrudes through piston plate 82, the bottom of the rolling diaphragm resting on the top surface of piston plate 82. Diaphragm 77 has a thin flexible outer edge for effectuating an operational airtight seal when the vacuum valve 50 is assembled. Piston cup 84 is placed within the diaphragm 77 which is telescoped over the end of shaft 58. Washer 86 and locknut 88 act to secure the piston cup 84 to the end of shaft 58. Spring 85 is then placed into the piston cup 84. The spring 85 acts to hold the vacuum valve in the closed position (ie, the spring provides the necessary bias which forces the vacuum valve to close at the end of one cycle). The upper housing 83 is then secured to the lower housing 80 by bolts 97, washers 89 and 91 and locknuts 90. The rolling diaphragm 77 is positioned securely between the upper housing 83 and the lower housing 80, thereby dividing the internal vacuum chamber into two separate cylinder chambers. The rolling diaphragm 77 will effectuate a fluid seal between each chamber.

Lubricant is applied to screw plug 76 and the assembly is then threaded into the wye body 52 which is threaded to receive screw plug 76, with the O-ring 46 preventing leaks at the point of connection.

Accordingly, operation of the vacuum valve 50 will now be explained. As can be viewed from FIGS. 2–4 during operation of the vacuum valve 50, when the unit controller 99 is activated, vacuum valve 50 is opened during a transport cycle, and the vacuum subatmospheric pressure of the transport system will be applied to the internal dip tube 92 as a result of the system operation. Normally, when the vacuum valve is closed, the internal dip tube 92 is at atmospheric pressure. When the vacuum valve opens, the spring 85 will be compressed and the shaft 58 will be pulled into the upper housing 83, but with sufficient clearance with respect to within the piston cup 84 and upper housing 83 to be eliminated, as the vacuum is applied to the dip tube 92. During operation of the system, when the vacuum valve is in the open position, the presence of the vacuum or subatmospheric pressure will cause the conical tapered plunger 61 to be pulled upward into the internal valve chamber by the piston cup 84. This is because as the vacuum or subatmospheric pressure is applied against the upper housing 83, diaphragm 77 is caused to be pulled up into the upper housing 83, which causes the piston cup 84 to likewise move up into the upper housing 83, resulting in the conical tapered plunger 61 being pulled into the upper valve chamber, thereby causing the valve seat 56 to be pulled away from the bottom of the internal valve stop 71 of the wye body 52. The valve seat 56 is normally engaged against the wye body valve stop 71 when the valve is in the closed position, thereby preventing sewage from flowing. As shown in FIG. 4, the valve seat 56 is angled in construction to enable the successful engagement with the internal valve stop 71 which is integral to the wye body 52.

From the foregoing it will be seen that this invention is one well adapted to attain all the ends and objects hereinabove set forth, together with the other advantages which are inherent to the invention. Since many possible embodiments may be made of the invention without departing from the scope thereof, it is understood that all matter herein set forth or shown in the accompanying drawing is to be interpreted as illustrative and not in a limiting sense. It is understood that certain features and subcombinations are of utility and may be employed without reference to other features and subcombinations; this is contemplated by and is within the scope of the claims.

While the preferred embodiment has been described, variations thereto will occur to those skilled in the art within the scope of the present inventive concept which are delineated by the following claims.

What is claimed is:

1. In a vacuum sewerage transport system, including a control valve having an open position and a closed position, said control valve comprising:

a valve body having an entry opening and exit opening;

a valve stop in the valve body disposed to separate the openings when said valve is in the closed position;

a rigid valve plunger disposed for reciprocating movement in the valve body relative to said valve stop to alternately open and close the valve, said plunger having a first end closest to said valve stop and a second end opposite said first end, said plunger having seating means on said first end of the plunger matable with said valve stop to provide closure of the control valve, said plunger having a diameter which is progressively and sharply reduced from the first end to the second end to facilitate opening of the valve and to eliminate jamming of the valve caused by accumulation of foreign objects; and a coaxially disposed shaft connected at its first end to the first end of the rigid valve plunger and passing through the plunger, and at its second end to control means for selectively opening and closing said control valve in response to a predetermined condition of the sewerage transport system.

2. A vacuum sewerage transport system as recited in claim 1, wherein the seating means on the first end of said plunger comprises an assembly of coaxially disposed seating elements arranged to provide a generally annular beveled seating means which will eliminate the collection of foreign objects between said elements and assure valve closure.

3. A vacuum sewerage transport system as recited in claim 1, wherein shaft sealing means are provided relative to said plunger, without coming into contact with said valve stop, to preclude fluid leakage along the shaft when said valve is closed.

4. A vacuum sewerage transport system as recited in claim 1, wherein replaceable bearing means are provided between the rigid valve plunger and the control means for directing the shaft and the plunger carried thereby in a predetermined angular relationship with the valve stop and to assure closure during repetitive operations of the valve.

5. A vacuum sewerage transport system as recited in claim 4, wherein sliding liquid tight shaft sealing means are disposed adjacent to the bearing means, the shaft sealing means being adapted to prevent migration of fluid and fluid-borne contaminants along the shaft and into the control means.

6. In a vacuum sewerage transport system, including a non-jamming control valve having an open and a closed position, said control valve comprising:

means for sealing the vacuum valve against fluid leakage to a vacuum or subatmospheric pressure outlet;

means for opening and closing the vacuum valve in accordance with a predetermined pattern;

a rigid plunger having a centrally disposed axis, a first end, and a second end opposite the first end, said plunger having a diameter progressively and substantially tapered from the first end to the second end, the first end having a valve seat securely fastened thereto so as not to be pulled away from the first end during repetitive operation of the vacuum valve, said valve seat positioned at a predetermined angle to its centrally disposed axis, the second end connected to said means for opening and closing the vacuum valve; and a conduit of a predetermined size, adapted to receive said substantially tapered, rigid plunger, said conduit having a first inlet opening and a second outlet opening, said first inlet opening being at atmospheric pressure, said outlet opening being at vacuum or subatmospheric pressure, said conduit having an integral valve stop which physically engages with said valve seat on the first end of said plunger when the vacuum valve is in the closed position.

7. A vacuum sewerage transport system as recited in claim 6, wherein the means for sealing the vacuum valve comprises in combination a wiper shaft seal, a diaphragm of a predetermined size having a flexible outer edge to effectuate an airtight seal, and a pair of O-ring seals of predetermined size, the diaphragm not coming into contact with said valve stop.

8. A vacuum sewerage transport system as recited in claim 6, wherein the means for opening and closing the vacuum valve comprises a piston means disposed to slide in a centrally disposed vacuum chamber within said conduit.

9. A vacuum sewerage transport system as recited in claim 8, wherein the piston means comprises a piston having a first end and a second end opposite the first end, said substantially tapered, rigid plunger secured to the first end of said piston.

10. A non-jamming vacuum valve having an open position and a closed position, the valve comprising in combination:

a piston having a first end and a second end opposite the first end;

a screw plug and lower piston housing assembly comprising:

a first sealing means;

a screw plug to which said first sealing means is attached, the screw plug having a top face with a centrally disposed recess;

a wiper shaft seal of a predetermined size;

a bearing adapted to receive the wiper shaft seal, said bearing secured to the recess in the top face of the screw plug;

a lower piston housing, said lower piston housing secured to the top face of the screw plug; and a second sealing means positioned between the lower piston housing and the top face of the screw plug;

an upper piston housing assembly comprising:

a piston plate;

a rolling diaphragm having an outer flexible edge about its circumference;

a piston cup which nests within the rolling diaphragm;

a spring member which nests within the piston cup to bias the vacuum valve in the closed position; and an upper piston housing, said rolling diaphragm secured along its outer flexible edge between the upper piston housing and the lower piston housing, said upper piston housing secured to the lower piston housing;

a wye body conduit of a predetermined size and adapted to receive the screw plug, said wye body conduit having a centrally disposed vacuum chamber into which said piston is fitted, and having a first inlet end and a second outlet end, said first inlet end being at atmospheric pressure, said second outlet end being at vacuum or subatmospheric pressure, said wye body conduit having an internal valve stop; and a substantially tapered rigid plunger secured to the lower end of said piston, the tapered plunger having a lower end, the lower end comprising a valve seat secured thereto, said valve seat physically engaging the internal valve stop of the wye body conduit when the vacuum valve is in the closed position.

11. The non-jamming vacuum valve of claim 10 wherein there is provided means for locating said lower piston housing on said top face of said screw plug.

* * * * *

US005082238B1

REEXAMINATION CERTIFICATE (2868th)

United States Patent [19] [11] B1 5,082,238

Grooms et al. [45] Certificate Issued May 7, 1996

[54] NONJAMMING VACUUM VALVE HAVING TAPERED PLUNGER

[75] Inventors: John M. Grooms, Rochester; Mark A. Jones, Cloverdale, both of Ind.

[73] Assignee: Burton Mechanical Contractors, Inc.

Reexamination Request:
No. 90/003,100, Jun. 21, 1993

Reexamination Certificate for:

| | |
|---|---|
| Patent No.: | **5,082,238** |
| Issued: | **Jan. 21, 1992** |
| Appl. No.: | **576,179** |
| Filed: | **Aug. 30, 1990** |

Related U.S. Application Data

[63] Continuation of Ser. No. 366,585, Jun. 15, 1989, abandoned.

[51] Int. Cl.[6] ..... F16K 31/126

[52] U.S. Cl. ..... 251/61.5; 137/205; 137/236.1; 137/907

[58] Field of Search ..... 137/205, 236.1, 137/907; 251/61.5

[56] References Cited

U.S. PATENT DOCUMENTS

| | | | |
|---|---|---|---|
| 123,996 | 2/1872 | Jones | 251/357 X |
| 129,923 | 7/1872 | Bourne | 251/357 X |
| 262,997 | 8/1882 | Tomlinson | 251/357 X |
| 3,807,431 | 4/1974 | Svanteson | 137/205 |
| 4,171,853 | 10/1979 | Cleaver et al. | 406/48 |
| 4,373,838 | 2/1983 | Foreman et al. | 406/14 |
| 4,826,132 | 5/1989 | Moldenhauer | 251/129.17 |

OTHER PUBLICATIONS

AIRVAC Vacuum Sewerage System Installation and Maintenance Manual, Airvac Division, Burton Mechanical Contractors, Inc., P.O. Box 508, Rochester, Indiana 46975, Copyright Aug. 1986, including FIG. F7-3, Exploded 3" Airvac Valve-Parts List; FIG. F7-5, Exploded 2" Airvac Valve-Parts List.

*Primary Examiner*—Gerald A. Michalsky

[57] ABSTRACT

A vacuum valve having a substantially tapered plunger for use in a vacuum operated sewerage transport system, the valve capable of facilitating a flow rate of thirty gallons per minute. It will not jam in the open or semi-open position as a result of repetitive cycling of the valve by the associated control unit. The plunger is mounted at one end of an axially disposed shaft of a piston operator in the valve chamber, which is effectively sealed to prohibit air leakage into a vacuum pressure conduit when the valve is in the closed position. Additional sealing elements are required and are designed to seal all liquids from entering the chambers containing the piston driving means or its associated control unit.

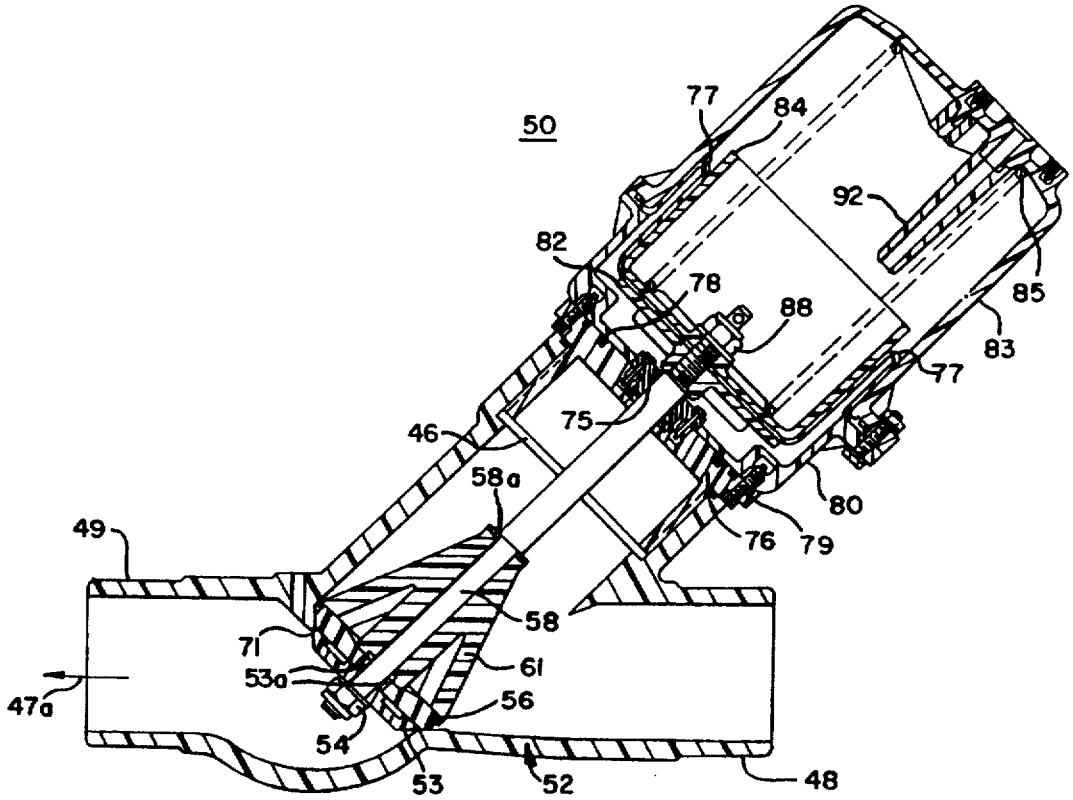

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–11 having been finally determined to be unpatentable, are cancelled.

* * * * *